US007598870B2

(12) United States Patent
Borean et al.

(10) Patent No.: US 7,598,870 B2
(45) Date of Patent: Oct. 6, 2009

(54) SYSTEM FOR AND METHOD OF AUTOMATING PARKING PAYMENT BY USING ELECTRONIC TAGS

(75) Inventors: Claudio Borean, Turin (IT); Maurizio Crozzoli, Turin (IT); Daniele Disco, Turin (IT); Tiziana Tambosso, Turin (IT)

(73) Assignees: Telecom Italia S.p.A., Milan (IT); Pirelli & C. S.p.A., Milan (IT)

( * ) Notice: Subject to any disclaimer, the term of this patent is extended or adjusted under 35 U.S.C. 154(b) by 276 days.

(21) Appl. No.: 11/596,002

(22) PCT Filed: May 12, 2004

(86) PCT No.: PCT/EP2004/005049

§ 371 (c)(1),
(2), (4) Date: Nov. 9, 2006

(87) PCT Pub. No.: WO2005/109348

PCT Pub. Date: Nov. 17, 2005

(65) Prior Publication Data

US 2007/0247333 A1 Oct. 25, 2007

(51) Int. Cl.
*G08B 13/14* (2006.01)

(52) U.S. Cl. ..... 340/572.1; 340/572.4; 340/572.8; 340/539.22; 340/932.2; 340/928

(58) Field of Classification Search ..... 340/572.1, 340/572.4, 572.8, 539.22, 932.2, 928
See application file for complete search history.

(56) References Cited

U.S. PATENT DOCUMENTS

| | | | | |
|---|---|---|---|---|
| 5,339,000 | A * | 8/1994 | Bashan et al. | 340/932.2 |
| 6,263,316 | B1 | 7/2001 | Khan et al. | |
| 2003/0054836 | A1 | 3/2003 | Michot | |
| 2003/0141363 | A1 | 7/2003 | Hjelmvik | |

FOREIGN PATENT DOCUMENTS

| | | | |
|---|---|---|---|
| DE | 298 11 377 | U1 | 3/1999 |
| EP | 0 987 646 | A2 | 3/2000 |
| WO | WO 00/11616 | | 3/2000 |
| WO | WO 01/13339 | A1 | 2/2001 |
| WO | WO 01/80193 | A1 | 10/2001 |
| WO | WO 01/99066 | A1 | 12/2001 |
| WO | WO 02/11074 | A2 | 2/2002 |
| WO | WO 02/084599 | A1 | 10/2002 |

* cited by examiner

*Primary Examiner*—Tai T Nguyen
(74) *Attorney, Agent, or Firm*—Finnegan, Henderson, Farabow, Garrett & Dunner, L.L.P.

(57) ABSTRACT

A system for automating parking payment including user terminals having wireless communication equipment allowing access to a wireless communication network and including readers/writers of electronic tags, electronic tags to be carried by the users on their vehicles and into which the users can input information concerning a parking event by means of their terminals; and a parking service management center connected to said network.

40 Claims, 3 Drawing Sheets

SYSTEM FOR AND METHOD OF AUTOMATING PARKING PAYMENT BY USING ELECTRONIC TAGS

CROSS REFERENCE TO RELATED APPLICATION

This application is a national phase application based on PCT/EP2004/0005049, filed May 12, 2004, the content of which is incorporated herein by reference.

FIELD OF THE INVENTION

The present invention refers to Radio Frequency IDentification (RFID) systems, and more particularly it concerns a system for automatic parking payment by using RFID transponders, also known as electronic tags (e-tags), and mobile terminals such as cellular phones and the like.

BACKGROUND OF THE INVENTION

In most towns of the developed countries, parking in certain areas is subjected to payment of parking fees. Payment is generally effected at parking meters, by inserting coins and/or by using prepaid cards. An individual meter can be installed at each parking place, or collective meters can be used, serving a specific group of parking places or distributed at more or less regular distances over the paying parking area. The check on the occurred payment is effected by authorised people (monitoring staff or wardens) by looking either directly at the parking meters or at a receipt to be exposed inside the parked vehicle and indicating the parking expiration time.

Use of parking meters entails a number of problems both for the parking service administration (or any other authority managing the service) and for the users. The administration has to take care of the maintenance of the parking meters, what entails high costs for both the material and the maintenance staff. The users have to provide themselves with the coins or the cards and, in case of collective meters, they are to find the proper or the closest meter and then to come back to the vehicle to leave the receipt. Moreover, there is no versatility about the end time of the parking, which may lead to overpayments. This is rather uncomfortable.

Parking payment can be effected also by special prepaid vouchers corresponding to predetermined parking durations. Use of the vouchers is more comfortable for the users, which are no longer to search for a parking meter, however they always are to provide themselves in advance with the vouchers. Moreover, the problems for the administration still exist, since payment by means of vouchers does not replace payment at the parking meters.

Several solutions have been already proposed for automating the parking payment.

U.S. Pat. No. 6,263,316 discloses an electronic toll collection system that can be used, inter alia, for collecting parking fees. The system is based on an automatic identification of a vehicle and of an associated account to which the parking fees can be charged. A suitable transponder capable of emitting an identification signal must be carried with the car, and an interrogating unit must be provided at the parking entrance/exit. That unit is connected to a management centre containing a database of the accounts. This solution is suitable for parking lots in which entrance/exit is controlled by a barrier actuated by the interrogating unit, but it is not suitable for payment of the parking along the town streets, which would require a reader at each parking place.

WO-A 02/11074 discloses a system allowing payment of the parking fees by using a mobile telephone or the like. The mobile telephone has a removable cover with a transponder acting substantially as an e-tag that is read by an e-tag reader in the parking meter. The parking meter has also means for transmitting information, such as tariff information, to the mobile station. The system further comprises a central station that receives information from the parking meters and that can communicate with the mobile station for receiving therefrom information about the desired parking duration and the consequent electronic payment instructions, or for informing the user of the expiration of the parking time and asking for further payment. The system does not eliminates the parking meters, and thus the problems mentioned above still exist, with the only exception of the need for the users to provide themselves with coins or a payment card. The need to connect the meters with the central station and to equip them with e-tag readers and means for communication with the mobile station makes the system complex and expensive.

US 2003/0141363 discloses a parking payment system that allows dispensing with the use of parking meters. The users can dialogue with a central station through their mobile phones to communicate the parking commencement and end, after having provided themselves with a "starting packet" including user-specific codes to be communicated to the central station, monetary amounts etc. Also the monitoring of the parking payment by the wardens requires a communication with the central station through the mobile network.

Parking payment systems therefore generally make use of parking meters, while systems not making use of parking meters require that both users and parking wardens communicate with a central station through a mobile network.

According to the invention, there is on the contrary provided a system for automating parking payment by use of mobile terminals and e-tags, which dispenses with use of parking meters and generally of any kind of stationary equipment in the paying parking areas and also allows locally performing at least part of the payment operations and the check on the occurred payment.

SUMMARY OF THE INVENTION

According to the invention, there is provided a system for automating parking payment by utilising user terminals consisting of wireless communication equipment allowing access to a wireless communication network, the system comprising:

- readers/writers of electronic tags associated with the user terminals; and
  - electronic tags to be carried on users' vehicles, each tag having electronic circuitry where a respective identification code is stored and into which a user can input information concerning a parking event by means of his/her terminal.

The invention also provides a method of automating parking payment, comprising the steps of:

- providing parking service users with user terminals allowing access to a wireless communication network and including electronic tag reader/writer capability, and with electronic tags to be carried on the users' vehicles, each tag having electronic circuitry where a respective identification code is stored; and
- writing, by a user intending to park, information concerning a parking event into said tag by means of the user terminal.

In a first embodiment of the invention, payment is managed by a service management centre, which is accessible by the users through the wireless network and includes a data base where payment information are associated with the tag identification codes, and which, upon payment, grants the user the authorisation to park and to write information about the parking event into the tag.

In a second embodiment, the tag acts also as payment card and stores a monetary amount or credit.

In both cases, the invention reduces the accesses to the communication network by the users and by the wardens. Indeed, in the first embodiment, access of the users to the service centre is necessary only at the arrival in the parking place, to start the authorisation procedure. In the second case, no direct access of the users to the service centre is generally required. In both embodiments, the checks on the payment may be carried out locally.

BRIEF DESCRIPTION OF THE DRAWINGS

Preferred embodiments of the invention, given by way of non-limiting example, will now be disclosed with reference to the accompanying drawings, in which.

DESCRIPTION OF THE PREFFERRED EMBODIMENTS

Figure 1:
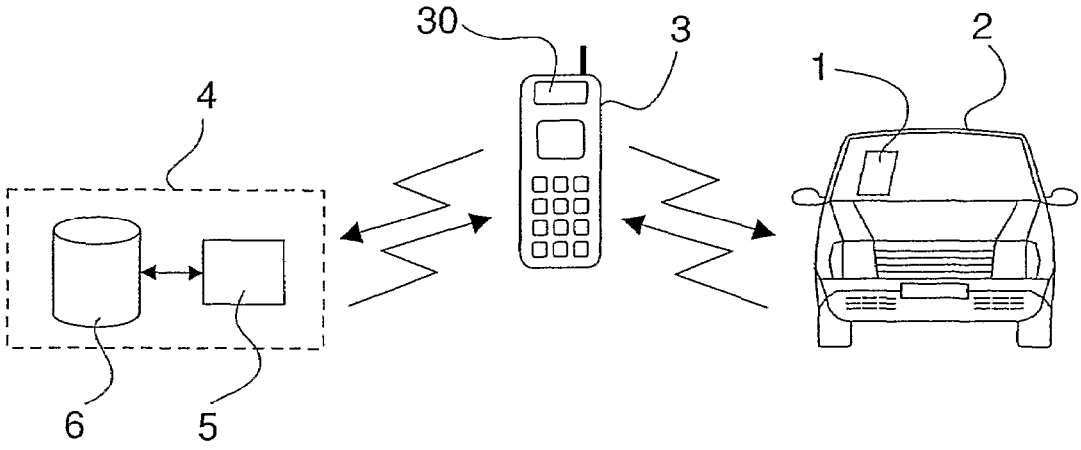
FIG. 1 is a schematic representation of the system according to the invention.

As shown in FIG. 1, a system according to the invention essentially comprises three elements:

- an e-tag or transponder 1 specialised for use in connection with a parking service, which tag is to be carried on vehicle 2 to be parked;
- a mobile user terminal 3 capable of accessing a mobile or wireless communication network and of communicating also with e-tag 1 for reading/writing information; and
- a service management centre 4.

In system embodiments in which a visual monitoring of the occurred payment is not possible or relying on it is not deemed sufficient, the system should also include monitoring terminals with which the wardens are to be equipped in order to perform such monitoring.

Figure 2:
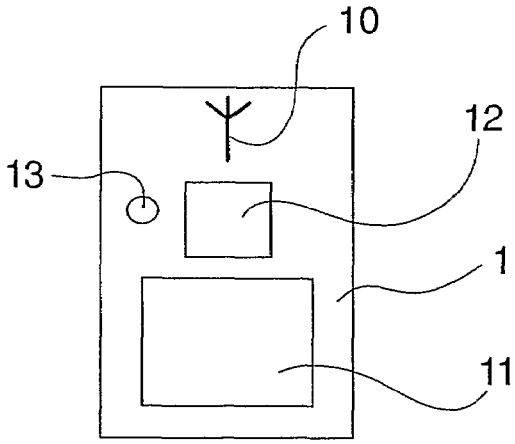
FIGS. 2 and 3 are schematic representations of an e-tag and a mobile terminal required by the invention.
Figure 3:
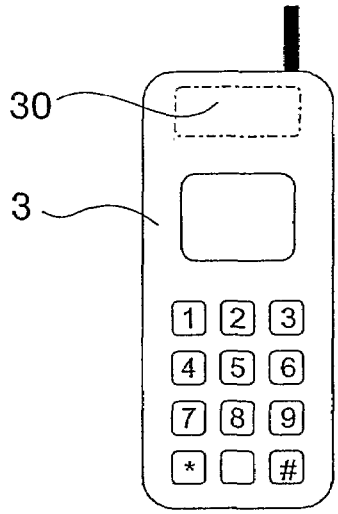

As shown in FIG. 2, an e-tag 1 suitable for use in the invention essentially comprises:

- an antenna 10, the size of which depends on the system operating frequency (e.g. 868 MHz, 2.45 GHz, 5.8 GHz with the present standards for the e-tags);
- electronic circuitry 11 devoted to data processing and typically comprising: a chip for the RF and base-band signal processing; a microprocessor, possibly associated with a cryptographic block for communication ciphering; a memory for data and programs, such as a flash memory, an EEPROM etc., storing, inter alia, an e-tag identification code; and a power supply, for instance a battery such as chemical cells (lithium or rechargeable) possibly coupled to solar cells (photo-voltaic accumulators), micro fuel cells; and
- a low consumption display 12 and/or a LED 13.

E-tag 1 can be operated in different manners, depending on how the parking payment is managed.

In a first embodiment of the invention, payment is managed by service management centre 4, to which the users directly access through the communication network, as it will be explained in more detail below. In such case e-tag 1 has, inter alia, the functions of a sort of electronic voucher or receipt, to be "filled" by the user with information related to the parking duration paid for, for instance the parking expiration time and the parking tariff selected for payment, to be possibly displayed to the wardens through display 12 or LED 13.

For instance, display 12 can directly display the parking expiration time. In the alternative or in addition, the expiration of the parking time, and/or the approaching of such expiration, could be signalled by using LED 13.

A LED might be used even in place of the display in order to assist in power consumption reduction of e-tag 1, thereby maximising the operating life of the tag and reducing the costs connected with recharging or replacing the tag.

In a second embodiment of the invention, e-tag 1 acts as payment means, while the mobile terminal is used for interacting with the tag (parking activation/deactivation, credit recharging, tag operation and maintenance, etc.). In this case e-tag 1 is to be loaded with a monetary amount or credit, and electronic circuitry 11 must allow subtracting the parking fee from the available credit. For instance, electronic circuitry 11 can comprise a timer that starts counting down e.g. from a value representative of such a credit when the vehicle arrives at the parking place and is stopped when the vehicle leaves the parking place. The timer counting rate should be preferably programmable to allow payment according to different parking tariffs. E-tags 1 can also store information about the different tariffs set by the service administration.

In this second embodiment display 12 and/or LED 13, if present, are intended for exclusive use by the user, to inform him/her of the correct starting of the countdown. This may be obtained thanks to a suitable message on display 12 or to a blinking or temporary lighting on of LED 13.

E-tags 1 may be active or passive e-tags. The structure of the electronic circuitry of both kinds of e-tags is well known in the art. Addition of a display and/or a led and possibly of a timer is not a problem for the skilled in the art. The e-tags can be supplied to the users of the service by the town administration or some other authority managing the service, possibly through authorised dealers.

Advantageously, e-tags 1 are freely displaceable from one vehicle to another Mobile terminal 3 is a cellular phone or any other equipment capable of accessing a mobile communication network and embodies an e-tag reader/writer 30. Mobile terminals modified in this manner have been disclosed in the literature. For instance the e-tag reader/writer 30 may be incorporated, either partly or as a whole, into the SIM card of the terminal, as disclosed for instance in WO-A 01/80193.

Even if generally e-tag 1 will be written/read by the user while being in or very close to vehicle 2, it may be convenient that the e-tag reader/writer is of a kind exhibiting a relatively long operation range.

Service management centre 4 is schematically shown in the drawing by a processing unit 5 and a database 6 storing at least the identification codes of e-tags 1 and, possibly, information about payments or credits related to each card.

In the first embodiment of the invention, service management centre 4 enables the user's access to the service whenever a user intends to park and manages the relevant payment by the user. Processing unit 5 will perform, in co-operation with database 6, all checks required for such enabling and all operations related to the payment. In such embodiment, database 6 might also store information about the different parking tariffs envisaged for the different town areas, to be communicated to the user when he/she accesses the service.

For allowing the enabling, a registration procedure is to be envisaged, by which an association between an e-tag 1 and one or more user terminals 3 is for instance established in database 6. Possibly, database 6 also stores a user profile that can be used by the parking service administration for offering the user various value-added services.

Different manners may be envisaged for debiting the user: e.g., the service centre can act as a POS (Point Of Sale) terminal; the user can have a deposit account with the service administration, and the parking fee is debited to such an account; the parking fees could be subtracted from the amount stored in the mobile phone of the user for the payment of the communications, if an agreement between the parking service administrator and the mobile network operator exists; and so on. The invention is compatible with various manners in which the user can be actually debited.

Service management centre 4 could also be involved in the check of the correct payment, even if preferably such a check is performed locally on e-tag 1.

In the second embodiment of the invention, e-tags 1 themselves are loaded with a monetary amount and no access to service centre 4 through the mobile network is required of the users when the need to park arises. Loading and restoring such credits on e-tags 1 are preferably entrusted to the mobile network operator, which will make the proper agreements with the parking service administration in order to inform it of the e-tag reloading and to transfer the corresponding money amounts to it.

At least in that second embodiment of the invention, the parking wardens should be equipped with a respective monitoring terminal (not shown), in the simplest form an e-tag reader, allowing monitoring the internal status of e-tag 1 to check whether a payment is in progress (credit subtraction/erosion). Such a monitoring terminal is necessary also in the first embodiment of the invention, if the e-tags have no display or LED or if relying only on the display or the LED is not deemed sufficient. In such case, the wardens will read the contents of the tag memory by their own e-tag readers. E-tag readers in the form of portable instruments are well known in the art, as disclosed for instance in EP-A 0 987 646. Also the e-tag readers of the monitoring terminals will advantageously be readers with a relatively long operation range.

The monitoring terminals could also be mobile terminals similar to the user terminals, if it is desired that the wardens can access service management centre during the checks.

Figure 4:
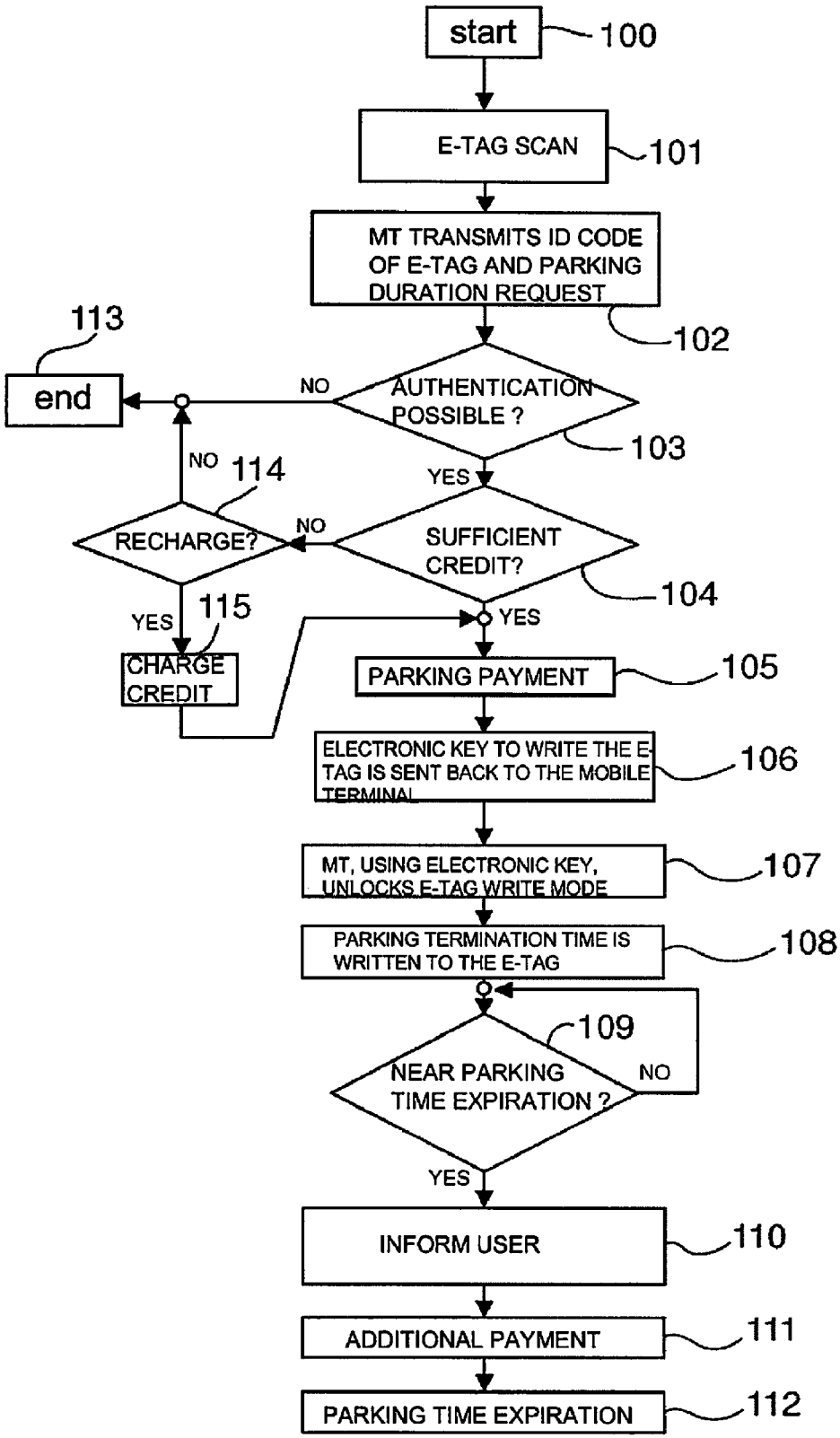
FIG. 4 is flow chart of the operation of a first embodiment of the invention.

The system operation according to the first embodiment of the invention will now be described with reference to FIG. 4.

When the need for parking arises (step 100), the user first scans e-tag 1 by means of terminal 3, thereby reading the identification code of the tag itself (step 101). By means of his/her terminal 3, the user then requests the authorisation to park to service management centre 4 (step 102), to which the user communicates the identification code just read as well as the desired parking duration and, possibly, information about the location of the parking place.

The manner in which communication with centre 4 takes place depends on the type of terminal 3. For instance, GSM, GPRS, UMTS or WLAN (Wireless Local Area Network) modalities could be used. The authorisation request can be automatically sent by terminal 3 to service management centre 4, if the service has been previously activated via software of by hardware means, or it may be sent by an SMS or an MMS message. For instance, the access to the parking service could be one of the functions stored in terminal 3 and accessible via the terminal menu.

Processing unit 5 in service management centre 4 checks, by looking at the contents of database 6, whether the user is a service subscriber and/or whether the identification code sent by the user corresponds with any of the codes stored in database 6 (step 103). In the negative, access to the service is denied (step 113). In the affirmative the request is processed.

In such stage, processing unit 5 first checks whether the user's credit is sufficient (step 104). In the affirmative, the parking fee is subtracted from the available credit (step 105). In the negative, recharging is required (step 114). If recharging is possible, it is effected (step 115) and the process restarts from step 105; otherwise access is denied (step 113). After the payment, processing unit 5 generates an electronic enabling key or code in one-to-one correspondence with the tag identification code and sends such a key to terminal 3, to allow the user to write information related to the parking event into e-tag 1 (step 106). Advantageously, information exchange between mobile terminal 3 and service management centre 4, in particular during the phases of communication of the tag identification code, payment and communication of the enabling key, takes place in encrypted form. For instance, the known "asymmetric key" encryption mechanism can be used, If the connection between terminal 3 and service management centre 4 is a GPRS or an UMTS connection, which is based on the Internet Protocol (IP), a reference configuration of IPsec/SSL type can be used for encrypted communication.

Also transmission of the identification code from e-tag 1 to user terminal 3 and of the enabling key from user terminal 3 to e-tag 1 preferably takes place in encrypted form. Cryptographic functions can be performed within e-tag 1 by hardware or software means; depending on the performance required of the system.

The information transmitted by the user and possible information of interest for building a user's profile are stored in database 6 of service management centre 4 and they can be used, as said, for other value added services (information about the traffic conditions in the parking area, advertising . . . ).

By using the key received from service management centre 4, the user enables e-tag 1 to writing (step 107) and writes the parking expiration time (step 108) by means of terminal 3. The user could also be requested to write information about the selected parking tariff into e-tag 1. The expiration time is then displayed on display 12 or signalled by LED 13, if such devices are provided in e-tag 1.

Taking into account that the parking time is stored also in service management centre 4, the latter, upon detecting that expiration of the parking time is approaching (step 109), could inform the user of this (step 110), e.g. by an SMS or MMS or the like. In such case the user could also provide for an additional payment in order to extend the parking duration (step 111).

The process stops when the parking duration paid for expires (step 112).

In the described embodiment of the invention, monitoring of the payment for a parked vehicle by the wardens is immediate. If display 12 indicating the expiration time is present, it is merely necessary to read the indication of the display, like in the present situation of paper receipts or vouchers. If the expiration time is signalled by LED 13, the check is still simpler, in that it is sufficient to check whether the LED is on or off, what can be detected also at some distance from the vehicle.

However, it is also possible to use e-tags without display or LED and to equip the wardens with monitoring terminals, capable of reading the information about the parking event from e-tag 1. It is also possible that the wardens read the identification code and check with management centre 4 whether the parking has been correctly paid. The use of the monitoring terminals could also be relied upon even when the e-tags are equipped with visual signalling units like display 12 or LED 13, to allow the wardens to read from tags 1 or to obtain from service management centre 4 information that are not visually signalled (e.g. the parking tariff).

The first embodiment of the invention allows eliminating the parking meters and significantly reduces the access to the mobile communication network. Indeed the users now only have to contact service management centre 4 at their arrival, and the check on the parking authorisation can be made locally.

In the second embodiment of the invention, not only the check, but also the payment operations are effected locally through e-tag 1, instead of requiring access to service management centre 4.

Figure 5:
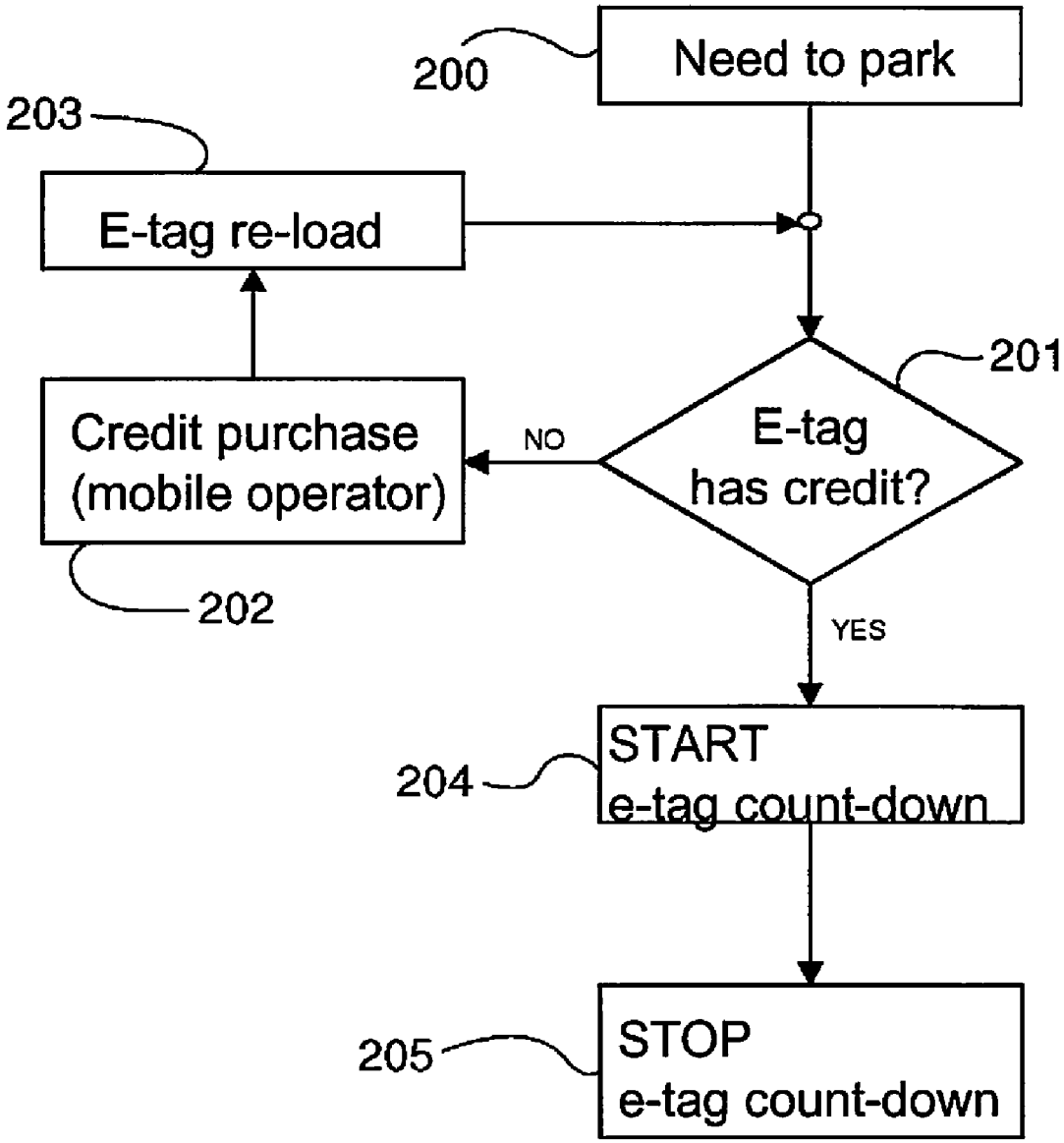
FIG. 5 is a flow chart of the operation of a second embodiment of the invention.

The operation of that second embodiment is now disclosed with reference to the flow chart of FIG. 5.

The user, when the need to park arises (step 200), checks through its terminal 3 whether a sufficient credit still exists on e-tag 1 (step 201). In the negative, the user contacts the mobile network operator to have its credit restored (steps 202, 203), e.g. transferring a certain amount from the telephone prepaid credit or debiting such amount on the telephone bill, and re-load the e-tag.

If the credit is sufficient (output yes of the check of step 201), the user chooses the proper parking tariff on e-tag 1, programmes accordingly the timer and starts the count down, i.e. credit erosion (step 204). When the user leaves with his vehicle from the parking, he/she stops the count down on the timer (step 205).

In order to avoid fraudulent use of the system, communication operations between the user terminal 3 and the e-tag are preferably protected by a ciphering mechanism (e.g. by means of an "asymmetric key" encryption technique) such that the e-tag can respond to its corresponding reader/writer only and keys resident into the reader/writer can benefit from standard security features of the reader/writer, if any. The keys can be pre-loaded in the e-tag and in the reader/writer associated to the user terminal during the activation phase of the service and even changed by the mobile operator during each credit re-charge operation, if necessary.

Always by using terminal 3, the user can check at any moment the operating condition of e-tag 1.

Similarly, the wardens can monitor by their own terminals whether the payment in regularly in progress.

Should the available credit on the tag run out during parking operations, a debit is accumulated and stored into the tag memory. Next time a parking operation is needed, on performing the necessary recharging, the accumulated debit will be paid.

By the second embodiment of the invention further advantages are achieved. The operations required of the user are greatly simplified and access to the mobile network is necessary only for restoring the credit on the e-tag: this entails a saving in the communication costs for the user and a reduced traffic load for the operator. Moreover, display 12 and/or LED 13 can make the user immediately aware of the fact that the parking payment operations have started properly. The fact that the information provided by display 12 or LED 13 are of interest only for the user reduces the possibility of frauds, provided the internal information of e-tag are suitably protected, since a user has no interest in simulating a message on display 12 or the activation of LED 13, since wardens do not rely on them for correct payment checking.

It is clear that the above description is given only by way of non-limiting example and that changes and modifications are possible without departing from the scope of the invention. For instance, display 12 or LED 13 could be used only to indicate the correct system operation to the user also in the first embodiment of the invention, and monitoring could rely on the use of monitoring terminals. Moreover, even if it has been assumed that the user communicates his/her position 117 to service management centre 4, to identify the location of the parking space, the user could be automatically located (for instance through a cell localisation procedure or another more accurate localization procedure in case of GSM or UMTS networks), and the service management centre could receive the relevant information from the network in order to identify the applicable parking tariff in database 6 and communicate it to the user.

The invention claimed is:

1. A system for automating parking payment by utilising user terminals provided with wireless communication functionalities allowing access to a wireless communication network, comprising:

readers/writers of electronic tags, said readers/writers being associated with the user terminals;

electronic tags to be carried on users' vehicles, each tag having electronic circuitry where a respective identification code is stored and into which a user can input information concerning a parking event by means of his/her terminal; and a parking service management center directly accessible by the user terminals through said network and comprising a data base for storing the electronic tag identification codes as well as information about payments related to a specific tag, wherein the parking service management center comprises a processing unit arranged to receive through the wireless communication network from a user intending to park, the identification code of a tag read by means of the user terminal, together with information about a desired parking duration and possibly a parking location.

2. The system as claimed in claim 1, wherein said processing unit is further arranged to:

check, by looking at the information stored in the data base, whether the user is authorised to access the service and whether a sufficient credit exists for the desired parking duration; and generate and transmit to the user terminal, in case of positive check, an authorisation to park comprising an electronic key.

3. The system as claimed in claim 2, wherein said electronic key is generated by said processing unit from the identification code of the tag.

4. The system as claimed in claim 2, wherein the user terminal is arranged to forward said electronic key to the electronic circuitry of the tag as a signal enabling writing information related to a parking event.

5. The system as claimed in claim 4, wherein said electronic tags, said user terminal and said processing unit comprise encryption units arranged to encrypt mutual communication at least during transmission of the identification code, the payment instructions and the electronic key.

6. The system as claimed in claim 1, wherein a plurality of electronic tags comprises a display for displaying a parking expiration time.

7. The system as claimed in claim 1, wherein a plurality of electronic tags comprises an LED for signalling either a regular parking condition or that the parking duration is about to expire and/or is expired.

8. The system as claimed in claim 1, wherein a plurality of electronic tags comprises a signalling unit for visually informing the user that the system is correctly operating.

9. The system as claimed in claim 2, wherein said database is arranged to store information about applicable parking tariffs, and said processing unit is arranged, upon receiving information about the user's location, to identify and communicate to the user the proper parking tariff.

10. The system as claimed in claim 9, wherein said processing unit is arranged to receive information about the user's location from the wireless communication network.

11. The system as claimed in claim 2, wherein said processing unit is arranged to generate and forward to a user terminal, through said network, a message indicating that an allowed parking duration is about to expire.

12. The system as claimed in claim 2, further comprising monitoring terminals comprising at least a tag reader, for allowing monitoring staff to read the contents of the electronic tags of parked vehicles for payment monitoring purposes.

13. The system as claimed in claim 12, wherein said monitoring terminals comprising a tag reader are wireless communication terminals arranged also to access the database of the service management center to get information necessary for payment monitoring.

14. The system as claimed in claim 12, wherein the electronic tag readers/writers of the user terminals and the electronic tag readers of the monitoring terminals are long-range readers/writers and readers, respectively.

15. The system as claimed in claim 1, wherein the electronic circuitry of said electronic tag is arranged to store information representative of a monetary amount and to subtract the parking fee from that amount.

16. The system as claimed in claim 15, wherein the electronic circuitry of said electronic tag comprises a down counter started and stopped by the electronic tag reader/writer of the user terminal at the beginning and the end, respectively, of a parking period and arranged to count down from the monetary amount available in the electronic tag.

17. The system as claimed in claim 16, wherein said down counter is programmable to count down according to a clock depending on a specific parking tariff.

18. The system as claimed in claim 15, wherein said electronic tag is equipped with a signalling unit for visually informing the user that the countdown is correctly started.

19. The system as claimed in claim 18, wherein said signalling unit is a display and/or an LED.

20. The system as claimed in claim 15, further comprising monitoring terminals comprising at least a tag reader for allowing monitoring staff to read the internal status of the electronic tag of a parked vehicle to detect whether a countdown is correctly in progress for that vehicle.

21. The system as claimed in claim 1, wherein the electronic tag reader/writer of a user terminal is incorporated into a SIM card of the user terminal.

22. A method of automating parking payment, comprising the steps of:

providing parking service users with user terminals allowing access to a wireless communication network and including electronic tag reading/writing capability, and with electronic tags to be carried on the users' vehicles, each tag having electronic circuitry where a respective identification code is stored;

writing, by a user intending to park, information concerning a parking event into said tag by means of the user terminal;

providing a parking service management center directly accessible by the users through said network, with a data base storing the tag identification codes as well as information about payments related to a specific tag;

reading the tag identification code from the electronic circuitry of the tag by means of the user terminal; and setting up a communication with the service management center through said network in order to transmit said identification code to the service management center together with information about a desired parking duration and possibly about a concerned parking location.

23. The method as claimed in claim 22, further comprising:

receiving from the service management center a parking authorisation in the form an electronic key; and transmitting said electronic key to the concerned electronic tag to enable writing information about the parking duration into said tag.

24. The method as claimed in claim 23, wherein said electronic key is generated by the service management center from the identification code transmitted by the user.

25. The method as claimed in claim 23, wherein the communication between the electronic tags and the user terminals and between the user terminals and the service management center for transmission of the identification codes, the payment instructions and the electronic keys occurs in an encrypted form.

26. The method as claimed in claim 23, further comprising the step of displaying a parking expiration time on the tag.

27. The method as claimed in claim 23, further comprising the step of visually signalling on the tag either a regular parking condition or the expiration, and/or the near expiration, of the parking duration.

28. The method as claimed in claim 23, further comprising the step of communicating, by the service management center to a user, information about an applicable parking tariff.

29. The method as claimed in claim 28, wherein said information is obtained by means of a user localisation performed by the wireless communication network.

30. The method as claimed in claim 23, further comprising the step of communicating, by the service management center to a user, that the parking expiration time is expiring.

31. The method as claimed in claim 23, further comprising the steps of:

providing monitoring staff with monitoring terminals including at least a tag reading capability; and having tag contents read from the tags of parked vehicles by the monitoring staff for payment monitoring purposes.

32. The method as claimed in claim 23, further comprising the steps of:

providing monitoring staff with monitoring terminals including both tag reading capability and access capability to said communication network;

having tag contents read from the tags of parked vehicles by the monitoring staff; and having a communication with the management center set up by the monitoring staff through the communication network in order to obtain information necessary for payment monitoring.

33. The method as claimed in claim 22, further comprising the steps of:

providing a monetary amount in each said tag;

at each parking event, starting a countdown from the monetary amount available in the electronic circuitry of the tag of the concerned user; and stopping said countdown when parking has been terminated.

34. The method as claimed in claim 33, wherein a counting rate of said countdown is programmable by the user based upon a parking tariff required by a specific parking location.

35. The method as claimed in claim 33, further comprising the step of visually displaying to the user, through the electronic tag, the correct start of the count down.

36. The method as claimed in claim 33, further comprising the step of checking whether sufficient credit exists on the tag for a desired parking duration in a parking place and, in the negative, obtaining further credit through an access to the network in order to restore the monetary amount loaded on the tag.

37. The method as claimed in claim 36, wherein said restoring of the monetary amount loaded on the tag is performed by a user through his/her terminal.

38. The method as claimed in claim 33, wherein, in case of a credit running out during a parking event, a debit is accumulated in the electronic tag and is automatically paid at the subsequent restoring of the monetary amount on the tag.

39. The method as claimed in claim 33, further comprising the step of equipping monitoring staff with monitoring terminals including tag reading capability.

40. The method as claimed in claim 39, further comprising the step of having the internal status of the tag of a parked vehicle read by said monitoring staff through said monitoring terminals to check whether a countdown is correctly in progress for a parked vehicle.

* * * * *